US005823233A

United States Patent [19]

McHenry, Jr.

[11] Patent Number: 5,823,233

[45] Date of Patent: Oct. 20, 1998

[54] APPARATUS FOR CUTTING AND CRIMPING COIL

[75] Inventor: David C. McHenry, Jr., Stone Mountain, Ga.

[73] Assignee: Unicoil, Inc., Norcross, Ga.

[21] Appl. No.: 889,407

[22] Filed: Jul. 8, 1997

[51] Int. Cl.[6] ..... B21F 35/02

[52] U.S. Cl. ..... 140/92.7; 140/103

[58] Field of Search ..... 140/24, 92.7, 92.94, 140/103

[56] References Cited

U.S. PATENT DOCUMENTS

| | | | |
|---|---|---|---|
| 1,813,035 | 7/1931 | Draaeger | 140/92.7 |
| 2,107,217 | 2/1938 | Salsman et al. | 11/1 |
| 2,300,544 | 11/1942 | Freundlich | 11/1 |
| 2,961,012 | 11/1960 | Freundlich | 140/92.3 |
| 3,568,729 | 3/1971 | Freundlich et al. | 140/103 |
| 3,688,809 | 9/1972 | Negro | 140/92.4 |
| 3,972,109 | 8/1976 | Sickinger | 29/434 |
| 4,095,623 | 6/1978 | Lemburg et al. | 140/92.7 |
| 4,153,081 | 5/1979 | Lemburg et al. | 140/92.7 |
| 4,161,196 | 7/1979 | Fabrig | 140/92.4 |
| 4,228,830 | 10/1980 | Boyadjian | 140/102 |
| 4,253,499 | 3/1981 | Lemburg | 140/92.7 |
| 4,327,780 | 5/1982 | Lehmann | 140/92.7 |
| 4,501,304 | 2/1985 | Lehmann | 140/103 |
| 5,497,811 | 3/1996 | Pigna | 140/71 |

*Primary Examiner*—Lowell A. Larson
*Attorney, Agent, or Firm*—Bernstein & Associates

[57] ABSTRACT

A cutting and crimping apparatus (14) for automatically cutting and finishing the ends of a spiral coil. The apparatus (14) comprises a jaw set (17) comprising a first fixed plate (20), a second fixed plate (50), a cut plate (70) and a push plate (130), each plate having a tooth extending therefrom capable of engaging the coil. The plates are substantially flat and disposed in sliding contact with each other. The cut plate (70) of the apparatus (14) is driven in a reciprocating, substantially linear motion by a linkage (100) mechanically coupled to a motor (18).

13 Claims, 4 Drawing Sheets

APPARATUS FOR CUTTING AND CRIMPING COIL

FIELD OF THE INVENTION

The present invention relates to spiral binding machines, and more particularly to an apparatus for cutting and crimping the end of a spiral binding.

BACKGROUND OF THE INVENTION

In the spiral binding of flat sheets, such as paper, a length of coil is threaded through holes at the ends of the flat sheets to bind them together. Once the coil is threaded all the way from one side to the other side of an end of the sheets, the coil is cut and crimped. The coil is cut so that it does not extend too far beyond the edge of the flat sheets which would be unsightly and would waste material. The severed end of the coil should be crimped so that the coil cannot unnecessarily rotate and unwind from the bound sheets. The preferred crimp for the severed end of the coil is one that is bent at an approximately ninety degree angle from the direction of the last turn of the coil and is directed inward and parallel to the longitudinal axis of the coil. It is also preferable to have the crimp extend back to touch or be proximate to the adjacent turn of the coil. The finishing of the crimp is important not only to keep the coil from unwinding but also for preventing snags from occurring. Crimps that are improperly made can easily snag on other coils when bound materials are stacked on top of one another. Also, poorly crimped coil can snag on clothing or other items when a single binder is being carried by a user.

Several tools and machines have been developed for cutting and crimping the end of a coil. Most of the devices utilize a shearing or scissoring action with a pair of cooperating blades that move past one another as they rotate about a pivot point. Such devices also provide for bending the remaining portion of the coil during the continued forward rotation of the cutting blade. The point where the blades pass to cause the scissors cut is offset to one side and a bending surface is provided for bending the severed end at an approximately ninety degree angle. The severed end is pushed around the bending surface by the travel of one of the cutting blades as it continues to rotate about the pivot point beyond the point where it passes the other blade. Because of the need to have the blades pass one another to get the extra travel or rotation required to bend the severed end, most of the prior art devices focus on a set of blades that are movable past one another on a pivot. For example, a hand-held manual crimper is widely available from a number of sources including the Sickinger Company of Auburn Hills, Mich. and has opposed blades that are pivoted together and have handles on the opposite end just like a pair of scissors. The blades pass one another to cut by scissors action. The point where the scissors cut takes place is offset so that extra material from the severed end is available for bending around a bending surface. The severed end is bent across the bending surface at a right angle immediately after it is cut by the continued motion of one of the cutting blades.

Another apparatus that utilizes pivoting blades is a device having a set of cutting and bending teeth that is known to those skilled in the art as a Sickinger jaw set also available from the Sickinger Company. The Sickinger jaw set works on the same basic principle as the hand tool described above but includes additional features and is designed to be attached to a table and operated by a lever arm. The Sickinger jaw set has a pair of opposed blades with cutting teeth that move past one another on a pivot. The device is spring biased about the pivot in the open position. As with the hand tool, the jaw set incorporates cutting blades that pass each other and a tooth having a bending surface that shapes the severed end of the coil at a right angle immediately after the cut is made. The Sickinger jaw set includes another tooth for clamping the coil during the cutting and bending process. This tooth pivots independently about the same pivot, but is also capable of engaging with the pivoting cutting tooth. The unit is operated by a lever arm that rotates the cutting tooth and the clamping tooth about the pivot. The clamping tooth travels the same arc as the cutting tooth but is limited in its travel by the top of the bending tooth. The clamping tooth and the bending tooth form a set of opposed clamping members for holding the coil in place during the cutting process. The first cutting tooth rotates past an opposed cutting edge on the second cutting tooth to create the scissors action and is limited in its travel beyond the second cutting tooth by the tension of the spring. After passing the second cutting tooth, the first cutting tooth continues its arc of rotation to bend the severed end of the coil around the bending tooth.

The above described cutting and crimping devices are not completely satisfactory for cutting and crimping coil because they have not been able to produce consistent, high quality crimps. With the blades passing each other on a pivot, the coil is urged forward out of the jaws of the device by the scissors action and therefore, the cuts are not uniform. Nonuniform cuts can result in crimps that are too short to reach the adjacent turn of the coil and that do not extend in the right direction or angle with respect to the longitudinal axis of the coil.

U.S. Pat. No. 2,300,544, issued to Freundlich, discloses a cutting and crimping apparatus with one fixed blade and one rotating blade. The rotating blade rotates about a different axis than the blades in the hand tool and the Sickinger jaw set, but still operates off of a pivot (albeit a different pivot point). Freundlich also does not incorporate an active clamping member to hold the coil in position during the cutting and crimping process. Accordingly, the Freundlich device does not avoid the problems with crimping that are present in the prior art.

Both the manual hand-held crimper and the Sickinger jaw set have rotating blades that operate off of a pivot. The resulting scissors action tends to urge a round coil out of the mouth of the blades during the cutting stroke which can lead to inaccurate cutting.

What is needed is a cutting and crimping device that does not operate by a pivoting or rotating blade and therefore does not tend to urge a round coil out of the mouth of the blades and which consequently produces high quality crimps with a high degree of repeatability.

SUMMARY OF THE INVENTION

The present invention solves the above described problems by providing an apparatus for cutting and crimping coil that generally comprises an electrically operated jaw set comprised of sliding flat plates having cutting and bending surfaces that cooperate.

In a preferred embodiment, the present invention provides a first fixed plate having a first tooth with a cutting edge extending therefrom. A second fixed plate is disposed parallel to and in a spaced apart relation with the first fixed plate. The second fixed plate has a second tooth extending therefrom. A cut plate is disposed between the first fixed plate and the second fixed plate and is capable of movement relative to the fixed plates in a reciprocating, substantially linear motion. The cut plate has a third tooth with a cutting edge. The cutting edge on the cut plate passes by the cutting edge on the first fixed plate to create the shearing action to cut the coil. After the cut is made, the cut plate pushes the severed end of the coil around the bottom of the second tooth to form the ninety degree bend on the crimp.

A push plate is disposed adjacent to the second fixed plate and is capable of moving relative thereto. The push plate has a fourth tooth extending therefrom which extends across a portion of the second fixed plate so that the tooth on the push plate and the tooth on the second fixed plate form a pair of opposed clamping members that hold the coil in place during the cutting and bending of the coil. The push plate is biased by a spring or other biasing means with the opposed clamping members juxtaposed with each other. The push plate engages with and is driven by the cut plate for a portion of its stroke. During the other portion of the stroke, the push plate is driven by the spring.

The cut plate is driven by an electric motor through a linkage. The linkage includes a lever arm that is driven by a crank. The crank is connected to a wheel that is rotated by the crankshaft of the motor. An electrical circuit controls the motor which generates the entire stroke of the cut plate with each revolution of the crankshaft.

In operation, the coil is positioned in the device with a turn of the coil disposed between the teeth on the fixed plates and the teeth on the push and cutting plates. Once the coil is in position, the device is activated by depressing a power button which activates the motor causing the cut plate and push plate to move toward the fixed plates in unison. During this part of the cycle the push plate is being pulled toward the tooth on the second fixed plate by the spring and the cut plate is being driven by the linkage. Once the push plate reaches a certain distance from the second fixed plate, the push plate presses the coil against the tooth on the second fixed plate thereby holding it in place during the cutting and crimping process. At this point the motion of the push plate ceases. Next, the cut plate tooth moves forward independently of the push plate to cut the coil. The cut plate continues to move forward during and after cutting the coil and pushes the severed end around the bottom of the second plate tooth. After the crimp is made, the cut plate continues forward a short distance and then reverses its direction. While traveling in the opposite direction, the cut plate engages with and drives the push plate into the open position against the resistance of the spring. Once the jaw set opens due to the space created between the teeth of the plates, the motion of the moving plates stops. In this open position, the push plate has a force exerted on it from extension of the spring away from its equilibrium position, and the system is in position to begin a new cutting and crimping cycle.

There are several advantages to the present invention including the ability to provide optimal crimps with a higher degree of repeatability than what has been possible with the prior art devices. The elimination of the pivoting scissors action associated with rotating blades reduces the variations in the cut and the bend that result from the tendency of the round coil to be urged out of the blades during the scissors action. Another advantage to the present invention is that the blades are much simpler and less costly to manufacture than prior art blades as they can be stamped or powder formed rather than being formed with complex and expensive castings.

It is another object of the present invention to provide a crimp that is disposed at a right angle from the last turn of the coil and substantially parallel to the longitudinal axis of the coil.

It is yet another object of the present invention to provide a crimp that extends to the adjacent turn of the coil.

It is a further object of the present invention to provide a cutting and crimping device having a set of flat plates with a set of teeth extending therefrom for cutting and crimping the coil.

Another object of the present invention is to provide a cutting and crimping device that can be manufactured by stamping or powder forming.

Other objects, features, and advantages of the present invention will become apparent upon reading the following detailed description of embodiments of the invention, when taken in conjunction with the accompanying drawings and the appended claims.

BRIEF DESCRIPTION OF THE DRAWINGS

The invention is illustrated in the drawings in which like reference characters designate the same or similar parts throughout the figures of which.

DESCRIPTION OF THE PREFERRED EMBODIMENTS

Figure 6:
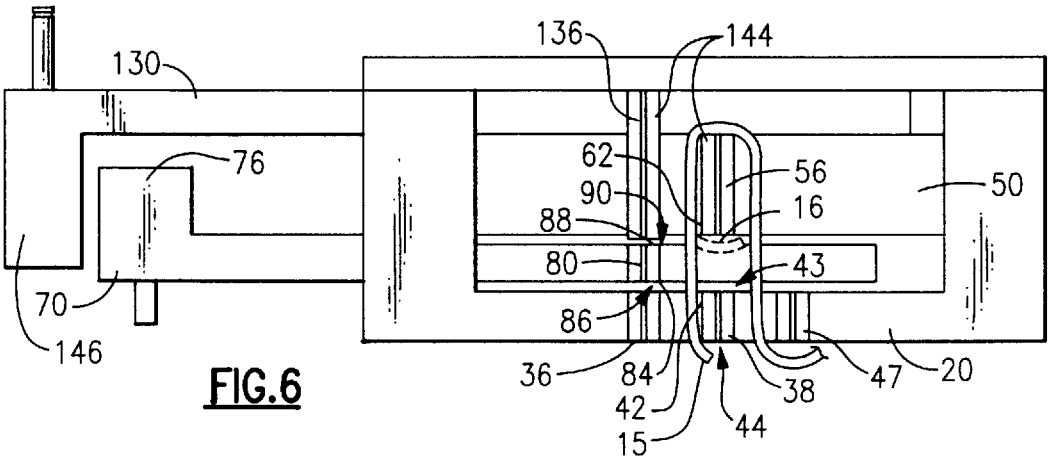
FIG. 6 is a side elevation view of the jaw set holding a piece of coil.

Referring to FIGS. 1–6, an apparatus 14 for cutting a coil 15 and crimping the severed end 16 includes a jaw set 17 that is mechanically coupled with a motor 18. The jaw set 17 comprises a first fixed plate 20, a second fixed plate 50, a cut plate 70 and a push plate 130. The components of the jaw set 17 are preferably manufactured by stamping or by powder forming and are preferably manufactured out of a metal, such as steel or the like, that is capable of withstanding sliding contact with other metal surfaces. The first plate 20 is preferably formed as part of a rectangular block 22 having a rectangular slot 24 passing through the block 22 from a first end 26 to a second end 28 and a rectangular opening 30 cut into the first side 32 of the block 22 to form a T-shaped slot 34. The plate 20 extends outward from the first side 32 of the block 22 and has a first tooth 36 and a second tooth 38 which project from the side 40 of the first plate 20 and are spaced apart a short distance. The teeth 36 and 38 are integrally formed with the plate 20 and resemble small teeth. As shown in FIG. 6, the second tooth 38 has a sharpened cutting edge 42 on a top edge 43. The outward facing ends 44 of the teeth 36 and 38 are preferably cut with a bevel or radius 45 for guiding the coil 15 into the space 46 between the teeth 36 and 38. The first plate 20 may be constructed with only the second tooth 38, but the presence of both teeth 36 and 38 provides a guide for positioning the coil 15 in the jaw set 17. Accordingly, additional spaced apart teeth such as tooth 47 could be placed on the first plate 20 to accept several turns of the coil to 15 for positioning.

A second fixed plate 50 is preferably a T-shaped, flat plate that is disposed substantially parallel to and in spaced apart relation to the first plate 20 by being placed into the T-shaped slot 34. The top 52 of the plate 50 fits into the rectangular slot 24. The base 54 of the plate 50 fits into the opening 30 in the first side 32 of the block 22 such that the base 54 abuts both ends of the opening 30 to prevent any lateral motion of the second plate 50 relative to the first plate 20. As an alternative, the second plate 50 could be integrally formed with the first plate 20 or connected to the first plate 20 in a different manner so long as the second plate 50 is parallel, spaced apart from and incapable of lateral motion relative to the first plate 20. For example, the plates could be stacked vertically on top of each other and connected by a set of bolts that pass through apertures in the fixed plates and that pass through slots in the movable plates such that the movable plates are placed in alignment with the fixed plates but are capable of motion relative thereto.

The second plate 50 has a tooth 56 substantially aligns de 58 which substantially aligns with the second tooth 38 on the first plate 20 when the second plate 50 is inserted into the rectangular block 22. The tooth 56 is preferably formed with a radiused edge 60 at the bottom corner 62. The radiused edge 60 facilitates bending of the severed end 16 of the coil 15 without cutting or scarring.

A cut plate 70 is preferably a flat plate having a T-shaped profile with the top 72 of the "T" capable of sliding in the rectangular slot 24 in the rectangular block 22. The base 74 of the "T" is narrower than the opening 30 in the first side 32 of the block 22 and therefore is capable of movement in the opening 30. The side of the cut plate 70 preferably includes a thicker section 76 and a connecting pin 78. The cut plate 70 has a tooth 80 extending from a side edge 82. The tooth 80 has a sharpened cutting edge 84 at the bottom corner 86. The top corner 88 of the tooth 80 has a radiused edge 90. The top edge of tooth 80 is lower than the top surface of the cut plate 70 to allow clearance for bending the severed end around tooth 56.

The cut plate 70 is positioned in the jaw set 17 between the first plate 20 and the second plate 50 and is capable of lateral reciprocal movement relative to the first plate 20 and the second plate 50 within the jaw set 17. Through movement of its top 72 within the rectangular slot 24, the cut plate 70 is capable of sliding between the plates 20 and 50.

Figure 7:
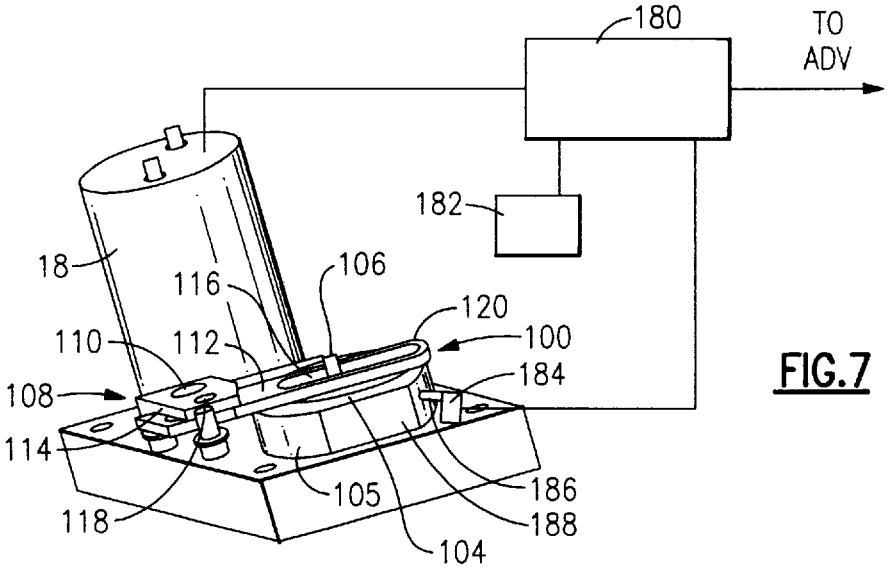
FIG. 7 is a perspective view of the drive mechanism.
Figure 9:
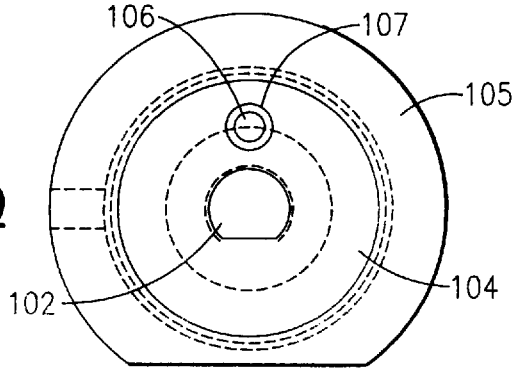
FIG. 9 is a plan view of the main drive.
Figure 8:
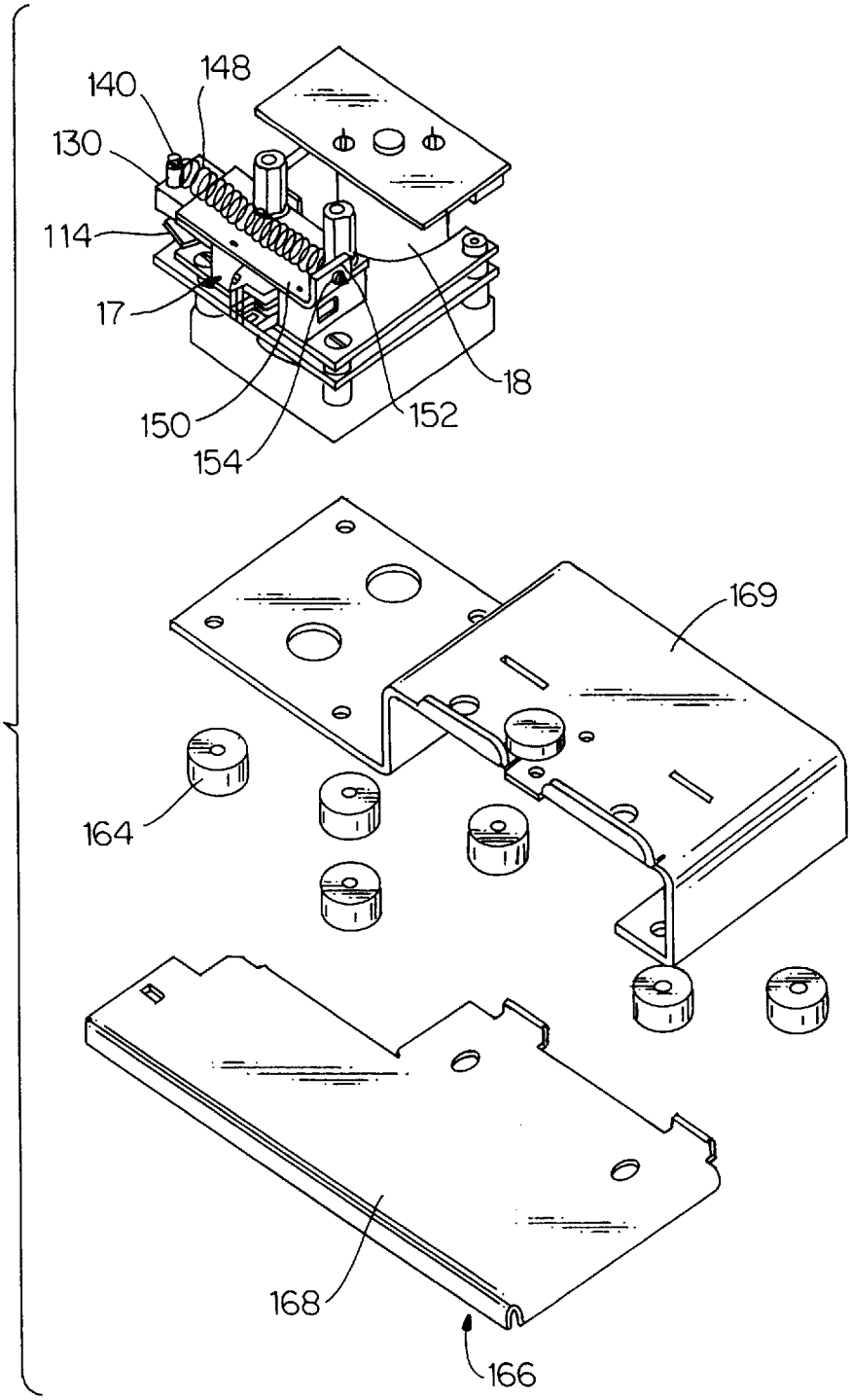
FIG. 8 is an exploded view of the housing, drive mechanism, and jaw set.

As shown in FIG. 7, the cut plate 70 is coupled to the motor 18 by a linkage 100. The motor 18 turns a crankshaft 102 with a wheel 104 attached to it (as shown in FIG. 8). The wheel 104 has a cam ring 105 and a crank pin 106 attached at a position offset from the crankshaft 102. The crank pin 106 has a bearing 107 that engages with a lever arm 108 that rotates about a pivot point 110. The lever arm 108 has a first leg 112 on one side of the pivot point 110 and a second leg 114 on the other side of the pivot point 110. The first leg 112 has a slot 116 defined therein. The bearing 107 travels inside the slot 116. Because the lever arm 108 is pivoted about a fixed point, the bearing 107 on the crank pin 106 traveling inside the slot 116 provides a reciprocating force against the lever arm 108 and a resulting moment about the pivot point 110. The second leg 114 of the lever arm 108 slidably engages with the connecting pin 78 at the back of the cut plate 70. The rotation of the crank pin 106 is thereby converted into a reciprocal, substantially linear motion of the cut plate 70 which moves in and out of the jaw set 17 along a straight line defined by the rectangular slot 24. The distance from the pivot point 110 to the distal end 118 of the second leg 114 where the crank pin 106 engages the lever arm 108 is approximately one-half of the distance from the pivot point 110 to the distal end 120 of the first leg 112 where it attaches to the cut plate 70. Accordingly, the force of the crank pin 106 against the lever arm 108 is doubled at the point where it is transmitted to the cut plate 70 because of length of the moment arm created by the first leg 112. It is to be understood by those skilled in the art that other means for driving the cut plate 70 in a substantially linear, reciprocal motion such as cams, pneumatic devices, hydraulic devices, and the like, can be substituted for the crank pin 106 and lever arm 108 of the present invention.

Figure 4:
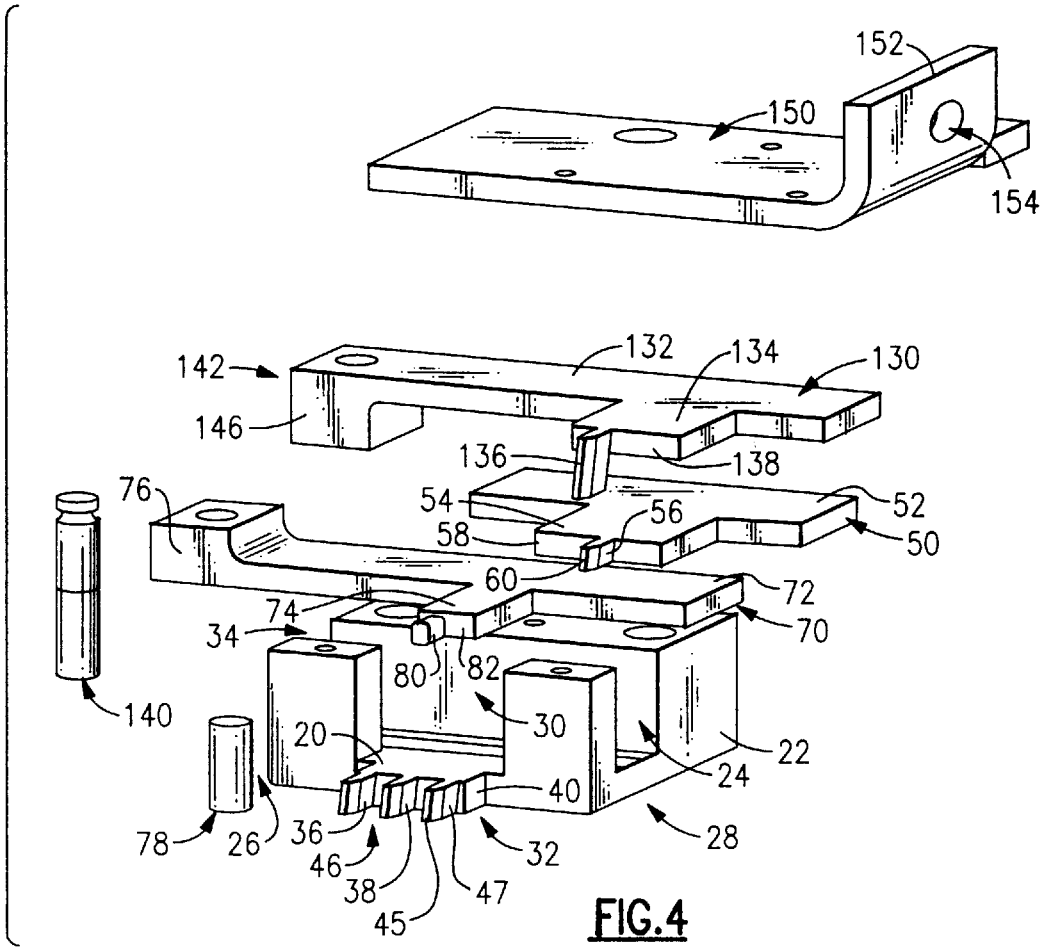
FIG. 4 is an exploded view of the jaw set of the present invention.
Figure 5:
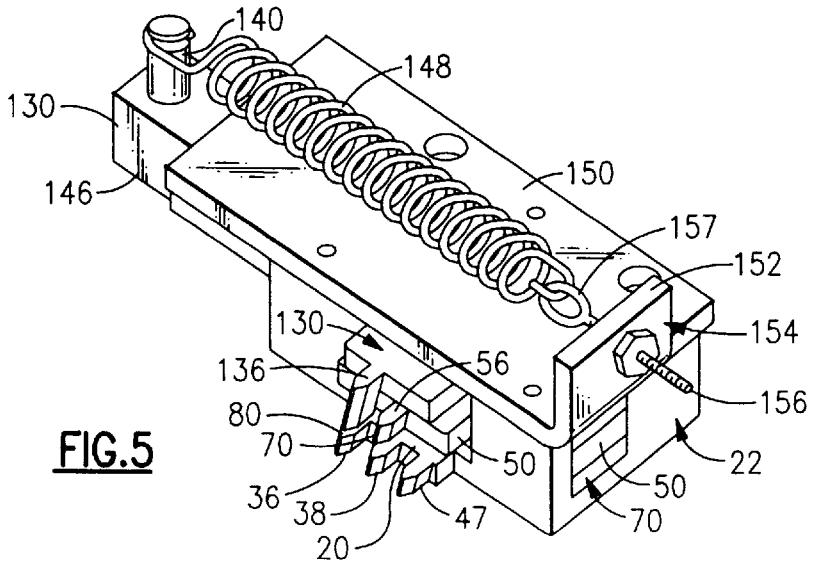
FIG. 5 is a perspective view of the jaw set.

Push plate 130 is preferably a flat plate having a T-shaped profile with the top 132 of the "T" capable of sliding in the rectangular slot 24 in the rectangular block 22 (best shown in FIG. 4). The base 134 of the "T" is narrower than the opening 30 in the first side 32 of the block 22 and therefore is capable of lateral reciprocating movement in the opening 30. The push plate 130 is positioned adjacent to and slides on the second fixed plate 50 and has a tooth 136 that extends from its side surface 138. The push plate 130 has a connecting pin 140 disposed on the end 142 located opposite from the tooth 136. The tooth 136 extends downward across the second fixed plate 50 in such a way that the tooth 136 and the tooth 56 form a pair of opposed clamping members 144. The end of the push plate 130 has an extended portion 146 that extends downward into the path of the cut plate 70 and is capable of engaging with the thicker section 76 of the cut plate 70. As shown in FIG. 8, the clamping members 144 are biased in the closed position by a spring 148 that attaches to the connecting pin 140.

After the plates 50, 70, and 130 are stacked in the rectangular block 22 on top of the first plate 20, an outer plate 150 is attached to the top of the rectangular block 22. The outer plate 150 has an extended portion 152 that preferably extends at an approximately ninety degree angle from the remainder of the plate 150. The extended portion 152 has an opening 154 defined therein for attachment of the spring 148. The spring 148 is preferably attached to the extended portion 152 by a bolt 156 having an eye hook 157. The bolt 156 is disposed through the opening 154. A thumbwheel nut 158 attaches to the bolt 156 and provides for adjustments of the tension of the spring 148.

Figure 1:
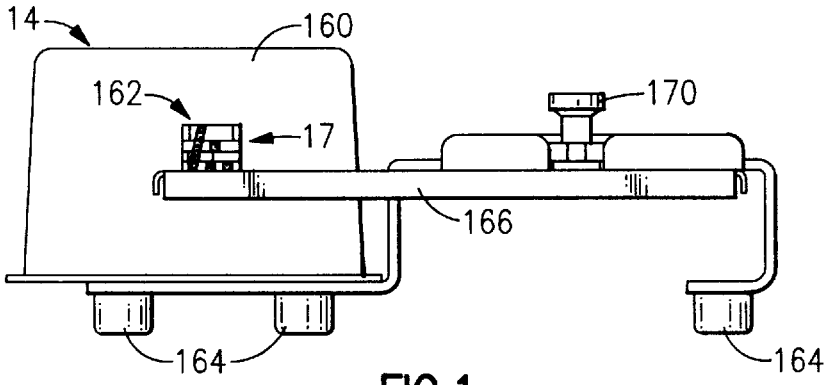
FIG. 1 is a front elevation view of the present invention.
Figure 2:
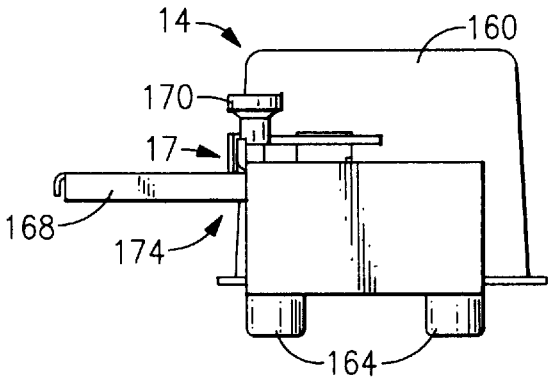
FIG. 2 is a side elevation view of the present invention.
Figure 3:
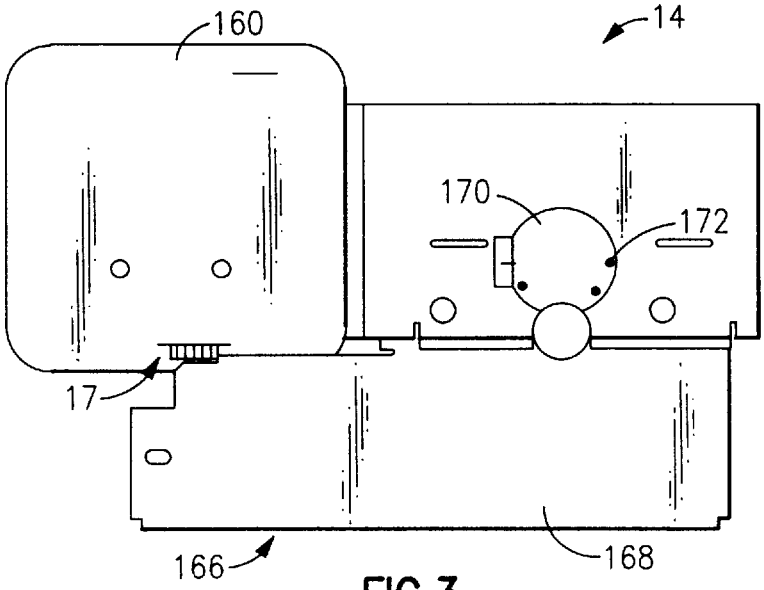
FIG. 3 is a top plan view of the present invention.

The apparatus 14 includes a cover 160 with an opening 162 for access to the jaw set 17 (best shown in FIGS. 1–3). The apparatus 14 is preferably equipped with feet 164 which are preferably constructed out of a surface gripping material such as rubber for traction and support of the apparatus 14 on a work table (not shown). An adjustable shelf 166 provides a surface 168 for supporting the coil 15 at the proper height for insertion into the jaw set 17. The adjustable shelf 166 attaches to a support 169 that provides a mounting for the shelf 166 and the jaw set 17 and drive mechanism. A dial 170 adjusts the height of the surface 168 relative to the jaw set 17. The dial 170 has markings 172 for setting the height of the surface 168 based on the inside diameter of the coil 15. Depending on the diameter of the coil 15, the surface 168 of the shelf 166 is raised or lowered. The correct height for the surface 168 is the point where the coil 15 resting on the surface 168 will fit into the jaw set 17 such that the cut plate 70 will sever the coil 15 in the vicinity of its midpoint. The adjustable shelf 166 is preferably hinged at the back end 174 and spring biased such that the surface 168 is disposed in a plane substantially parallel to the work table. In this manner the shelf 166 is normally in a horizontal position but can be rotated downward for minor "on the fly" adjustment of the shelf 166 with respect to the jaw set 17. This downward adjustment is useful for situations where it is desired to cut different diameter coils without readjusting the height of the shelf 166.

As shown in FIG. 7, the electrical motor control circuit 180 preferably accepts a 110V input and steps it down to a low voltage input for the electrical motor 18. The preferred voltage for the motor is 24V DC, however, higher voltage may be required depending on the characteristics of the coil. The control circuit 180 has two inputs for starting and stopping the motor 18. An operator-controlled switch 182, which may include a toggle, button, or other mechanical switch, activates the motor 18 whenever the switch 182 is moved from the open to the closed position. A cam operated switch 184 mechanically engages with the cam ring 105 preferably by contact with a wheel 186. When the wheel 186 encounters a flat section 188 of the cam ring 105, the cam switch 184 opens the circuit to stop the motor 18. The position of the blades in the jaw set 17, w hen the motor stops, is adjusted by rotating the cam ring 105 around the crank wheel 104. The position of the flat section 188 determines when the cam switch 184 is triggered and the motor 18 is shut off.

The electrical circuit 180 functions to allow an operator to activate a switch 182 which starts the motor 18. The cam switch 184 automatically drops out the power to the motor 18 when the flat section 188 on the cam ring 105 activates the switch 184. The circuit is preferably designed to allow for multiple sequences of starting and automatically stopping the motor 18 without having to reset any switches. Accordingly, the preferred circuit for starting and stopping the motors includes a set-reset flip-flop incorporating a two-input nand gate as is known to those skilled in the art.

The plates 50, 70 and 130 are all sized to fit inside the rectangular block 22, and assembly of the jaw set is accomplished by stacking the plates on top of each other within the block 22 (shown in FIG. 4). The T-shaped slot 34 maintains the plates in alignment and provides for one of the plates to be fixed relative to the block 22 and for other plates to be capable of motion relative to the block 22. The dimensions of the portion of the plate that fits inside the opening 30 in the first side of the block 32 determines whether or not the plate is capable of movement relative to the block 22. The fixed plate 50 is coterminous with the bounds of the opening 30 and therefore is not capable of movement. The moving plates fit inside the opening 30 with space remaining for travel in reciprocating movement. An outer plate 150 removably attaches to the block 22. In order to remove a plate for replacement, the outer plate 150 is removed and the plates slide out of the block 22. The plates connect to the linkage 100 via a pin 78 on the cut plate 70 that connects to the lever arm 108.

In operation, the cutting and crimping apparatus 14 of the present invention performs a discrete cutting and crimping operation for each revolution of the crankshaft 102. The cutting and crimping stroke begins with the jaw set 17 in the open position with the cut plate 70 and the push plate 130 retracted such that an individual turn of the coil 15 fits into the jaw set 17. Once the coil 15 is positioned in the jaw set 17 by placing a length of coil 15 across the surface 168 of the adjustable shelf 166, a switch 182 triggers the motor 18 to rotate the crankshaft 102 approximately one revolution. The spring 148 preferably preloads the second leg 114 of the lever arm 108 with a force synchronized with the movement of the crank pin 106. By preloading the lever arm 108, the start-up load on the motor 18, due to the inertia of the system, is reduced and/or eliminated, and therefore, the torque requirement for the motor 18 is reduced which enables the use of a smaller motor and reduces the wear and tear on the motor 18 from starting and stopping. In order to set the system so that the rotation of the crank pin 106 and the force of the spring 148 are synchronized when the next cycle begins, the cam ring 105 can be rotated on the cam wheel 104 to adjust the stopping point triggered by the flat section 188.

The cutting and crimping cycle of the apparatus 14 includes an inward stroke and an outward stroke for both the cut plate 70 and the push plate 130. During the inward stroke, the cut plate 70 and the push plate 130 move in unison but are driven independently. The cut plate 70 is driven by the crank pin 106 through the linkage 100, whereas the push plate 130 is driven by the spring 148. Once the clamping members 144 clamp and hold the coil 15, the travel of the push plate 130 ends. The cut plate 70 continues its inward stroke after the motion of the push plate 130 has stopped, and the cut plate 70 passes its cutting edge 84 across the cutting edge 42 on the first plate 20 to sever the coil 15. After the cut plate 70 severs the coil 15, it continues forward and the top corner 88 of the tooth 80 bends the severed end 16 of the coil 15 around the radiused edge 60. After the crimp is made, the cut plate 70 continues forward on the inward stroke until it stops traveling forward and begins the outward stroke.

At the beginning of the outward stroke, the cut plate 70 moves while the push plate 130 is stationary. As the tooth 80 on the cut plate 70 aligns with the tooth 136 on the push plate 130, the thicker section 76 of the cut plate 70 engages with the extended portion 146 of the push plate 130. Engagement is defined as the state of being in such contact that motion may be transmitted. From the point of engagement of the thicker section 76 with the extended portion 146 until the end of the stroke, the push plate 130 is driven outward against the force of the spring 148 by the force of the thicker section 76 of the cut plate 70 pushing against the extended portion 146 of the push plate 130. When the motor 18 stops, the jaw set 17 is in the open position and the lever arm 108 is preloaded by the spring 148. To begin a new cutting and crimping cycle, another coil 15 is inserted into the jaw set 17, and the switch 182 is activated.

The apparatus 14 of the present invention provides several advantages over previously developed apparatus. The present invention provides for automatic cutting and crimping without pivoting or rotating blades. The elimination of the pivoting blades reduces the variations in the crimps due to the fact that a round coil has a tendency to be urged forward out of the jaws of a pair of rotating scissors action blades.

Another advantage to the present invention is the ease of manufacture. The sliding plates of the present invention can easily be formed by stamping or powder forming and therefore greatly reduce the tooling costs associated with the prior art devices. Also, the plates can easily be installed and replaced.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

Claimed is:

1. An apparatus for cutting and crimping a coil, comprising:

a) a first fixed plate having at least one first tooth extending therefrom, the first tooth having a cutting edge;

b) a second fixed plate having a second tooth extending therefrom, the second fixed plate disposed substantially parallel to and in spaced apart relation with the first fixed plate;

c) a cut plate disposed between the first fixed plate and the second fixed plate and capable of moving relative to the first fixed plate and the second fixed plate, the cut plate having a third tooth extending therefrom, the third tooth having a cutting edge;

d) a push plate disposed adjacent to the second fixed plate and capable of movement relative to the second fixed plate, the push plate having a fourth tooth extending therefrom, the fourth tooth extending across a portion of the second fixed plate so that the fourth tooth and the second tooth are capable of forming a pair of opposed clamping members, the push plate being capable of engaging with the cut plate;

e) means for biasing the push plate such that the opposed clamping members are juxtaposed; and, f) means for driving the cut plate in reciprocating, substantially linear motion.

2. The apparatus of claim 1, wherein the second tooth has a radiused edge.

3. The apparatus of claim 1, wherein the third tooth has a radiused edge.

4. The apparatus of claim 1, wherein the biasing means comprises a coil spring.

5. The apparatus of claim 1, wherein the driving means comprises:

a) an electric motor having a crankshaft for output;

b) a wheel attached to the crankshaft;

c) a crank pin attached to the wheel at a position radially offset from the point where the crankshaft attaches to the wheel;

d) a cam ring attached to the wheel;

e) a lever having a first leg and a second leg, the first leg having a slot for capturing the crank pin, the second leg attaching to the cut plate to provide a reciprocal, substantially linear motion to the cut plate; and f) means for starting and stopping the electric motor.

6. The apparatus of claim 1, wherein the cut plate further comprises a first end and a second end, the first end being thicker than the second end.

7. The apparatus of claim 6, wherein the push plate further comprises a first end and a second end, the first end being thicker than the second end.

8. The apparatus of claim 7, wherein the first end of the cut plate engages with the first end of the push plate.

9. An apparatus for cutting and crimping a coil, comprising:

a) a rectangular block having material removed therefrom to form a T-shaped slot, the block having a first side with a substantially flat extension projecting therefrom and having at least one first tooth with a cutting edge;

b) a fixed plate having a second tooth extending therefrom, the fixed plate sized to fit snugly inside the T-shaped slot and to be fixed relative to the rectangular block, the fixed plate disposed substantially parallel to and in spaced apart relation with the extension on the rectangular block;

c) a cut plate having a third tooth with a cutting edge, the cut plate capable of being disposed in the rectangular block between the extension on the rectangular block and the fixed plate, the cut plate sized to be capable of sliding back and forth in the T-shaped slot, the cut plate having a first end and a second end, the first end being thicker than the second end and having a first connecting pin extending therefrom;

d) a push plate having a fourth tooth extending therefrom and being disposed adjacent to the fixed plate and capable of sliding back and forth thereon within the T-shaped slot, the fourth tooth extending across a portion of the fixed plate such that the fourth tooth on the push plate and the second tooth on the fixed plate are capable of forming a pair of opposed clamping members, the push plate having a first end and a second end, the first end being thicker than the second end and having a second connecting pin attached thereto and capable of engaging with the first end of the cut plate;

e) an outer plate attached to the rectangular block and extending across the T-shaped slot, the outer plate having an opening defined therein;

f) a coil spring attached at one end to the second connecting pin on the push plate and attached at the other end to the opening on the outer plate; and, g) means for driving the first connecting pin in reciprocating substantially linear motion.

10. The apparatus of claim 9, wherein the second tooth has a radiused edge.

11. The apparatus of claim 9, wherein the third tooth has a radiused edge.

12. The apparatus of claim 9, wherein the coil spring is connected to the opening on the outside plate by an adjustable mechanical fastener.

13. The apparatus of claim 9, wherein the driving means comprises:

a) an electric motor having a crankshaft for output;

b) a wheel attached to the crankshaft;

c) a cam ring attached to the wheel;

d) a crank pin attached to the wheel at a position radially offset from the point where the crankshaft attaches to the wheel;

e) a lever having a first leg and a second leg, the first leg having a slot for capturing the crank pin, the second leg attaching to the connecting pin on the cut plate to provide a reciprocal, substantially linear motion to the cut plate; and f) means for starting and stopping the electric motor.

* * * * *